United States Patent [19]

Kariagin

[11] 4,281,867

[45] Aug. 4, 1981

[54] DISENGAGING APPARATUS

[75] Inventor: Nikolai Kariagin, Chatsworth, Calif.

[73] Assignee: Whittaker Corporation, Los Angeles, Calif.

[21] Appl. No.: 83,420

[22] Filed: Oct. 10, 1979

[51] Int. Cl.[3] ..... B66C 1/34

[52] U.S. Cl. ..... 294/83 R; 9/44

[58] Field of Search ..... 294/83 R, 83 A, 83 AB, 294/84; 9/43–45; 24/230.5 R, 232 R, 241 PP, 241 SB

[56] References Cited

U.S. PATENT DOCUMENTS

| | | | |
|---|---|---|---|
| 905,576 | 12/1908 | Porter | 294/83 R |
| 1,086,667 | 2/1914 | Irwin | 9/44 |
| 1,301,392 | 4/1919 | Corser | 9/45 |
| 1,368,647 | 2/1921 | Myers | 294/83 R |
| 2,714,731 | 8/1955 | Binmore | 294/84 X |
| 3,132,888 | 5/1964 | Haller | 294/83 R |
| 3,177,028 | 4/1965 | Cozzoli | 294/83 A |
| 3,405,966 | 10/1968 | Harley | 294/83 R |

*Primary Examiner*—Johnny D. Cherry
*Attorney, Agent, or Firm*—Henry M. Bissell

[57] ABSTRACT

Disengaging apparatus including a hook pivotally located below its hooking point between a pair of plates, and having a counterbalanced cam locking structure wherein the force applied to the hook by the weight of the item being held causes positive engagement with a cam surface, but when the force applied to the surface falls below a predetermined level a counterweight rotates the cam structure away from the hook and allows rotation of the hook to open. The counterweight is further used to positively pull the hook to the open position after a given amount of travel. Additionally a locking structure may be provided to prevent accidental motion of the counterweight, and a spring-biased reset may also be provided.

17 Claims, 8 Drawing Figures

DISENGAGING APPARATUS

BACKGROUND OF THE INVENTION

1. Field of the Invention

The present invention relates to hooking and similar apparatus utilized as connections, for example, for cables. More particularly, the present invention relates to the cable connection for supporting, and eventually releasing, equipment such as survival capsules.

2. Description of the Prior Art

Numerous hooks have been designed and are used in industry at the present time. These often take the form of large hooks formed of steel, and having a spring-biased second piece which closes the open end of the hook to prevent release of the hook during operation.

Particularly in heavy industry, military and maritime situations, hooks are provided on a piece of equipment in order to make it more mobile, or to allow for it to be transferred from location to location. In these types of circumstances, large cranes and the like are utilized, and the chain or cable of the crane is provided with a large loop or ring which is to be engaged with the piece of equipment to be moved. In this type of circumstance, depending upon the particular use, it may be desirable to have a hook which can opened either under full load, or without load. This type of hook is in use in industry, in that the industry does provide hooks which are positively locked under full load but, as a result, are not designed to open under no load conditions. In the alternative, the prior art also provides for hooks which will either automatically, or with very simple operation, open when no load is applied, but generally this type of a hook is normally not easy to open in a loaded condition.

One of the common forms of hook available in the industry is the type which, under load, can be opened by use of a long line, chain or other device which actuates a releasing mechanism, and releases the hook when it is under load. In the other form, the action of releasing of the load by placement or by other means automatically releases the hook, and thus terminates the connection between the cable and the device being lifted. The disadvantage of the first form is that external action is required, and that the hooks are not easy to set or release when not under load. The disadvantage of the second form is that it remains locked in emergency situations when it is under load, and thus can present a significant saftety risk. Therefore, there is a significant need in the industry to provide an attaching device which can be set to release either automatically at a given lower load limit, or can be released under load.

One particular use of this type of equipment is the support of survival capsules or lifeboats aboard ship and on drilling platforms. Survival capsules are essentially enclosed boats that are increasingly being used as replacements for lifeboats on commercial vessels, cruise ships, and especially on drilling or other off-shore platforms. Even when stored, survival capsules and lifeboats are commonly supported by a cable on a hoist so that they may be loaded or entered, and quickly lowered over the side of a ship, or off the side of a platform.

Vessels of this type have particular need for a hook locking mechanism which cannot be released under load (that is, while the vessel is above the water) without substantial inconvenience and the requirement of conscious and deliberate steps to manually release the locking mechanism. This is accomplished by disengaging the coupling to the manual release drive means, typically a hand crank for driving the release mechanism, and stowing it in a location separate from the lock release drive mechanism. Thus it is not readily available to drive the release mechanism without a conscious effort by the operator who must retrieve it from stowage, transfer it to the vicinity of the drive mechanism and mount it in driving relationship thereon, all of which serves to eliminate the possibility that the vessel will be released under conditions when it is not clearly in the water and ready for release from the cable.

Conversely, it is extremely desirable that the same hook be capable of rapidly and simply releasing the lock mechanism, such as after reaching the water, without disturbing the safety protection when under load. Further it is desirable that this operation be entirely controlled by the helmsman, enabling him to determine the exact moment of release. Such a device should be automatic after the release of a safety pin or pins that, once removed, permit the automatic disengaging of the hook.

SUMMARY OF THE INVENTION

Embodiments of the present invention provide positive locking under load, automatic release of the lock when the load is descreased below a predetermined level (if the safety pin is released), and optional automatic reset in the closed position after complete release of the load. The hook portion of the present invention can be reloaded even in the locked condition and, additionally, has a separate safety pin to prevent unintended release of the hook.

In the apparatus, a hook and mounting structure are provided, normally for instance on the top of a survival capsule. The unit is quite compact, and includes a housing which is usually of metal plate manufactured or bolted to the surface of the equipment to be lifted. Normally, the housing is provided with an independent servicing or hoisting flange having a circular opening for attaching to and lifting of the unit.

The main hook utilized as the connection between the hoisting system, such as a cable and ring mounted on a crane or hoist, and the capsule is rotatably pinned between the two plates which form the housing, and the housing is normally provided with a covering to prevent fouling or damage. The disengaging portion of the apparatus that actually contacts the cable or ring, including the shaped portion of the hook, is positioned in a manner that upon release and rotation of the hook, the face of the housing assists in the positive disengaging of the ring from the apparatus. A spring-biased, normally U-shaped pivotal lock is provided at the open end of the hook, and is positioned in such a manner that in its released condition it either contacts, or comes very close to contacting, the small pointed end of the hook in the structure, and prevents the ring, when in position, from accidentally being separated from the hook. The biasing means is positioned such that the securing function can be overcome easily by pressure during inserting of the ring, but cannot be overcome by the reverse motion. A cam following surface is provided below and on the opposite edge of the ring engaging surface of the hook. The hook has, additionally, a lower angular protrusion adjacent the ring engaging portion which functions to further insure positive disengagment of the hook upon release.

The hook itself has a pair of protruding attaching eyes, the first being attached to a cable, chain or other flexible elongated structure which emerges from the housing at a point below the mounting of the hook and positively releases and pulls the hook about its pivot point, upon release of the cam from the cam mating surface. A second eye-shaped hooking portion is provided on the hook, below the pivot point of the hook, and is connected to a second flexible structure, which is spring-biased to a preset load to reposition the hook in its locked condition after complete release of load.

The cam mating portion of the hook is mated, in a locked condition, to a pivotal cam which may be rotated about its pivotal axis by virtue of forces applied through an elongated arm and created by a counterweight, a spring box, an hydraulic accumulator, a torsional spring, a prestressed hydraulic piston, or other appropriate means. The elongated arm is provided with, in the preferred form, a shaft between sections of the arm, which is positioned about a loop in the first flexible line, noted above, and after a given amount of travel, determined as defined below, the line comes in contact with the arm and positively rotates the hook about its pivot point, causing the release of the ring locked in the hook itself.

Additionally, an independent safety locking structure is preferably provided. The independent structure normally comprises a pin which is spring-biased into a locked position to prevent the arm from moving while it is locked. Normally the pin is positioned to block release of the hook locking mechanism and positive action by the operator is required to unlock the safety pin before the hook mechanism can be released.

In operation, the hook is placed in its locked position, and a ring is placed through the exposed portion of the hook. The external spring-biased safety structure prevents the hook from becoming disengaged upon accidental loss of tension in the cable supporting the ring and the remaining portions of the apparatus are locked in position (a) by virtue of the locking pin, if positioned, and (b) the placing of a load on the ring. The hook tends to rotate about its pivot point under load until it comes in contact with the cam. The cam then positions and holds the hook in its locked position under the load until such time as the load becomes sufficiently small, as designed, that the lever arm, functioning off of the cam shaft, is free to rotate about the cam pivoting axis. When the vessel is in the water and ready for release, the operator releases the safety pin, thereby unblocking the lever arm. Rotation is then initiated by the weight on the lever arm, and continues until such time as the first flexible line is engaged by the lever arm, and the weight of the lever arm then pulls the hook about its axis of rotation, and disengages the ring contained therein.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
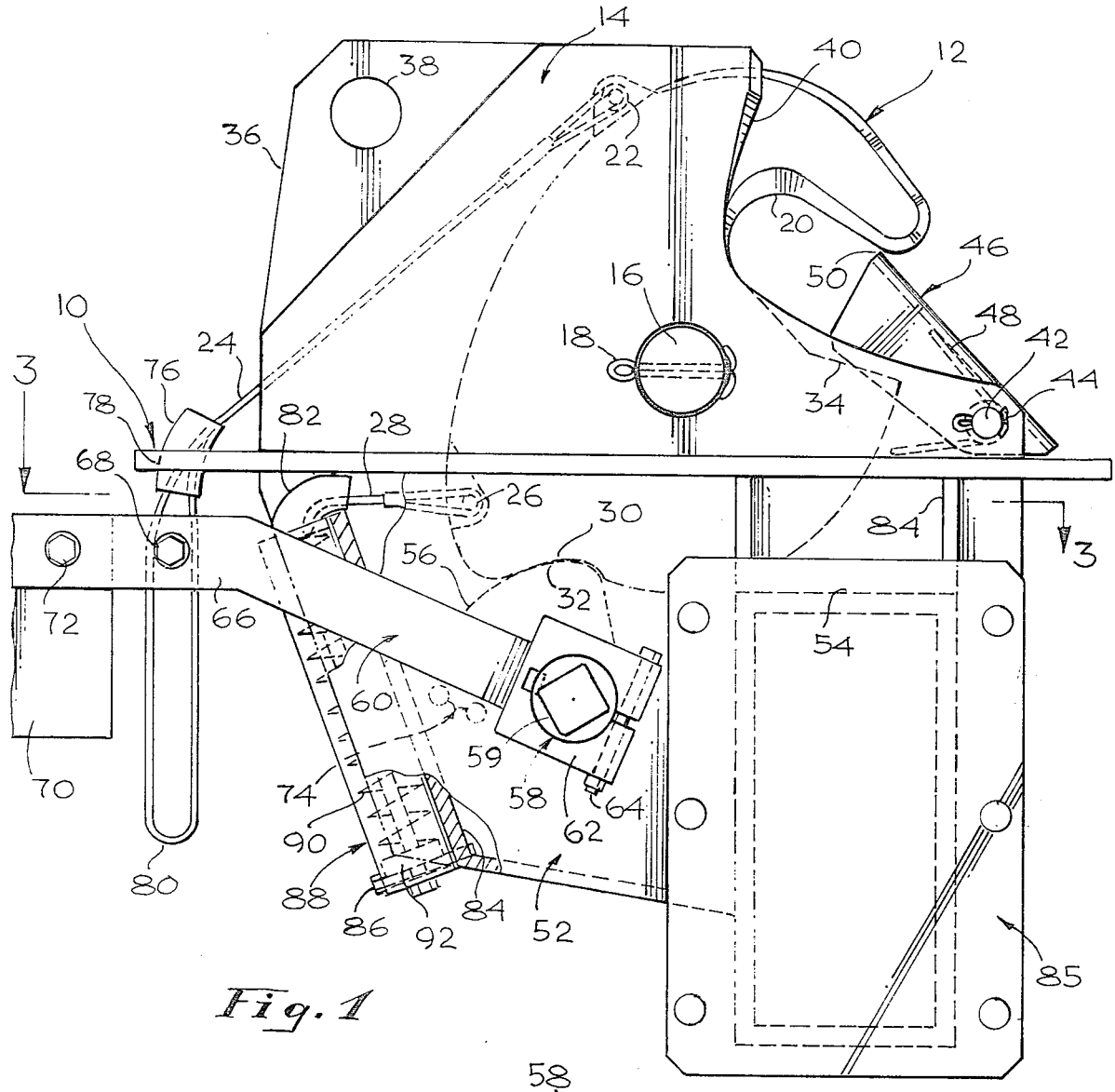
FIG. 1 is a side view of apparatus in accordance with the present invention.

The basic structure of the disengaging apparatus of the present invention is shown in FIG. 1. The apparatus may be used for many different purposes, such as boat or glider towing apparatus, a permanently attached hook on the upper portion of large equipment for moving and servicing such equipment, for survival capsules, lifeboats and the like. The present disclosure will describe the disengaging apparatus in relationship to its operation as the release mechanism for a survival capsule. In this context, the housing, or other structure utilized to position the apparatus is shown as 10. The actual hook, shown generally as 12, is positioned in a pair of vertical plates, one of which is shown as 14, by means of pin 16 and cotter key 18 such that hook 12 is capable of rotating about pin 16. Engaging area 20 of the hook is normally provided with a specific shape, as better shown in FIG. 5. The hook is further provided with a first eye or lug 22 for attachment of disengaging cable 24, and a second eye or lug 26 for reset cable 28. The eyes are not the only structure useful in this portion, and other means such as pins with related cotter keys, or other clamping structures, can be used to engage the support line which may be in the form of a steel cable, a chain, or other flexible, long-lasting materia. The hook is further provided with cam following surface 30, appropriately shaped for contact with cam surface 32. The hook is also provided with positive disengaging surface 34 which is positioned relative to hook engaging area 20 so that when the hook is rotated about pin 16, positive disengaging surface 34 comes in contact with the engaged ring or other structure, and assists in positively separating the ring or other structure from the hook.

One or both of plates 14 is provided with an extension 36 which is drilled to form hole 38 utilizable for hauling, hoisting or otherwise positioning the equipment attached to the disengaging apparatus herein, or for any other emergency or similar uses. Plates 14, positioned on either side of hook 12, are each provided with a release surface 40 which is curved relatively toward the forward portion of hook 12, and during disengagement act to positively disengage the ring or other structure held by hook 12 on its engaging surface 20. Additionally, at its forward end, each plate 14 is drilled, and pin 42 and related cotter keys 44 are provided to position U-shaped safety latch 46 which is spring-biased by spring 48 in a manner such that the forward end of latch 46 is normally in contact with housing 10. In this manner, the hook, when in the locked position, as shown, can be engaged with a hoisting ring or other structure by passing the ring between hook 12 and latch 46, overcoming the tension of spring 48. The spring whould then bias latch 46 back to its relatively closed position, such that the end 50 of the latch 46 is in close proximity to the end of the hook. The whole of this external structure as described is, with the exception of the hook and latch structure, preferably covered with an enclosure, not shown, in order to protect it from the elements when used on board ship. Plates 14 extend through housing 10 to form lower support structure 52, and are attached to tubular web or other bracing structure at surface 54. Cam 56 is positioned between lower support structures 52, and connected thereto by cam shaft 58 which, externally to lower support structures 52, is attached to lever arms 60 by, for example, clamping extensions 62 and bolts 64. There are a pair of lever arms, one external to each of the lower support structures 52 in order to balance torquing, and to provide two points of support for rotation of shaft 58. Also, for mechanical release, as by manual over-ride, a shaft coupling 59 is provided.

Lever arms 60 are normally provided with an angular bend 66 to a relatively horizontal orientation, and are also provided with shaft 68 joining both of the arms. Relatively rearward of shaft 68 is a counterweight 70 which is normally bolted to lever arm 66 by bolts 72. The result of this arrangement is a rotational biasing or torquing of cam 56 which tends to react at cam surface 32 and position hook 12 through contact with cam following surface 30. The particular geometry, i.e. the size of the hook, the distance between hook engaging area 20 and the axis of pin 16, the distance between the axis of pin 16 and cam following surface 30, and the size of cam 56, along with the length of lever arms 60 and the weight on counterweight 70, are all selected so that when a certain minimum vertical force is applied at surface 20, the resulting torquing of hook 12 aroung pivot 16 will produce a specific amoutn of force at cam following surface 30, and overcome the tendency of counterweight 70 to rotate cam 56 about shaft 58. In this manner, the amount of weight being held, or the force applied to the hook, is used to positively lock the hook during operation, but when the force reaches a preselected minimum amount, the torquing through shaft 58 overcomes the force applied to hook 12, and allows cam 56 to rotate in a counterclockwise direction, and thus release hook 12 and disengage the unit.

In order to provide positive locking of the lever arm and cam latching mechanism without the possibility of inadvertent release, safety pin structure 74 is provided, shown in detail in FIG. 6 and described hereinbelow. Further, disengaging cable 24 is attached to eye 22, passes between plates 14 and through guide 76 formed around aperture 78 in housing 10, and is provided with loop 80. This arrangement provides for the positive disengaging feature referred to above, since 80 is positioned around shaft 68 extending between arms 60. When counterweight 70 overcomes the force on hook 12, the counterweight rotates counterclockwise to a position where shaft 68 engages the bottom of loop 80 and, as a result, pulls hook 12 in a counterclockwise direction. This then releases the ring retained by hook 12 and produces the positive disengaging discussed above with regard to surface 40.

Additionally, in order to provide automatic reset, after release of the hook, if desired, rye 26 is connected with reset cable 28, which passes through reset guide 82 provided in support plate 84. Support plate 84 has attached to it spring housing 88 by, for example, bolts 86. Cable 28 passes into spring housing 88, and downward through the center of spring 90 to base plate 92. Spring 90 is not biased when the hook is in the locked position, as shown, but upon rotation about the axis of pin 16, reset cable 28 is extended and spring 90 becomes biased and tends to force the reverse rotation of hook 12, i.e. rotation in clockwise direction, to reset the hook when the lever arm is raised to stowing position.

Figure 2:
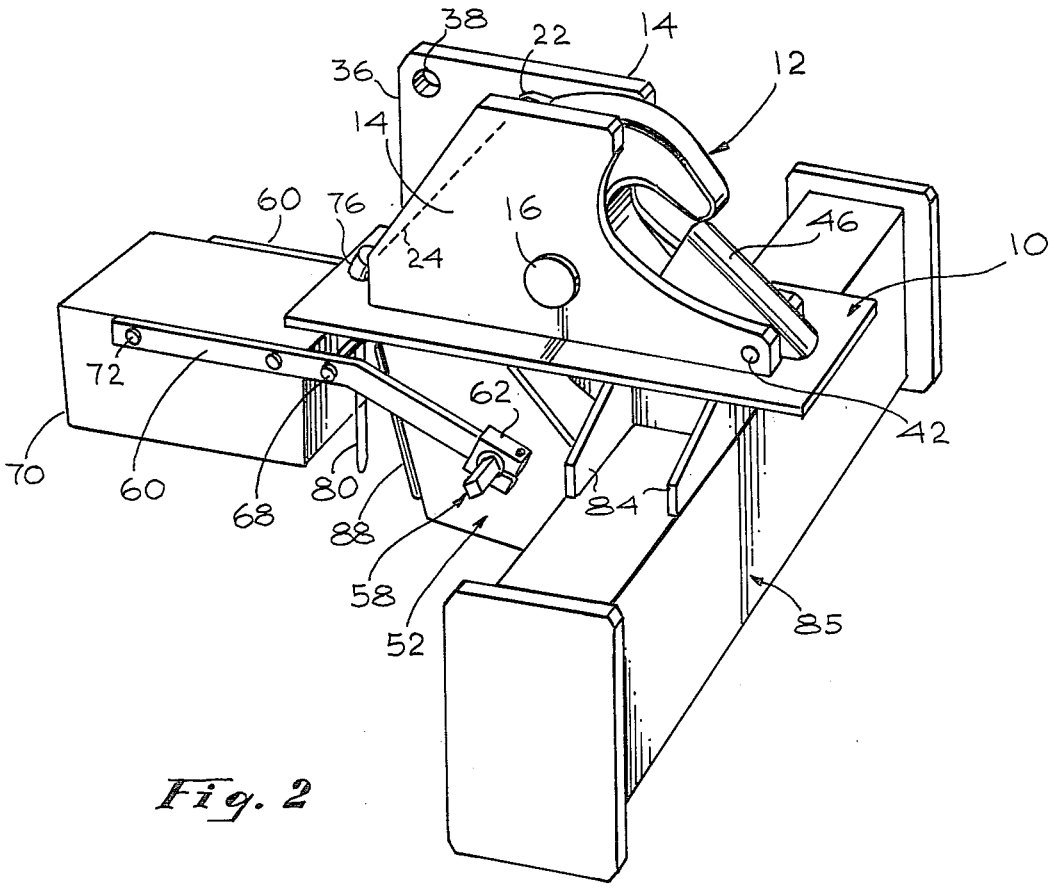
FIG. 2 is a perspective view of the apparatus of FIG. 1.

As particularly shown in FIGS. 1 and 2, hook 12 is supported on housing 10 by plates 14. Pin 16 rotatably mounts hook 12 between the plates. One of the plates is provided with extension 36, which is drilled to form hole 38, and thus provide a maintenance and/or service connection for the unit. The hook is shown in its engaged condition, with pin 42 positioning U-shaped safety latch 46 which is spring-biased by spring 48. Both of plates 14 extend to form lower support structure 52 and are braced to housing 10 through webbing or support plate 84 which is also attached to tubular support 85. In this manner, the whole of the disengaging apparatus of the present invention is positively attached in position on the survival capsule (see FIG. 8). Lever arms 60 support counterweight 70 through bolts 72. Disengaging cable 24 is connected to a lug 22 on hook 12 and passes downwardly through housing 10 by way of guide 76. Disengaging cable 24 has a loop 80 at its lower end, and passes around shaft 68 which is mounted between the lever arms. Reset spring housing 88 extends below housing 10, and encases a spring and cable (FIG. 1) utilized to reposition hook 12 after disengaging.

Figure 3:
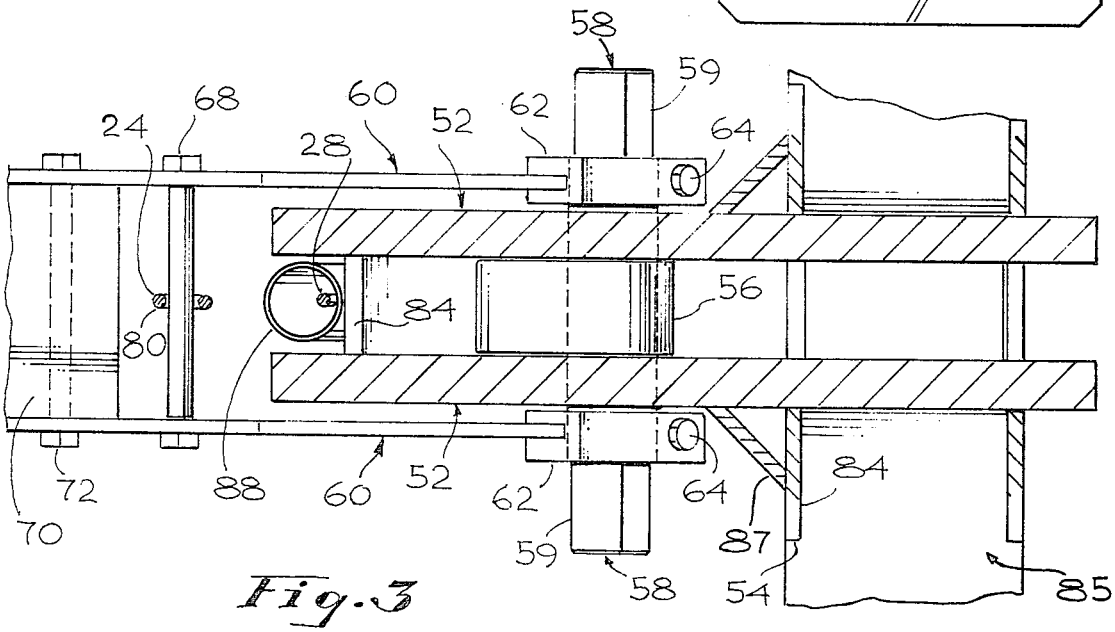
FIG. 3 is a top view taken along lines 3—3 of FIG. 1.

The section taken along lines 3—3 of FIG. 1 is shown in FIG. 3. In this figure, lower support plates 52 are mounted to tubular support member 85 by support webbing 87. Cam shaft 58 passes through lower support plates 52 and is connected to cam 56 between the two plates. The plates are further braced against the support members 84 and 85. Shaft 58 has lever arms 60 mounted at either end through clamping extensions 62 and bolts 64. The lever arms are also joined outboard of plates 52 by shaft 68 which is also used to move disengaging cable 24 (shown here in section). Further, counterweight 70 is positioned on both lever arms through bolts 72.

Finally, reset cable 28 is shown in this view as it enters spring housing 88. As can be seen from the drawing, the lowering of counterweight 70 will not only rotate shaft 58 and cam 56 to disengage the cam from the hook but will thereafter engage disengaging cable 24 and pull the hook 12 into the disengaged position. The locking structure, discussed hereinbelow, has been omitted from this figure for sake of clarity.

Figure 4:
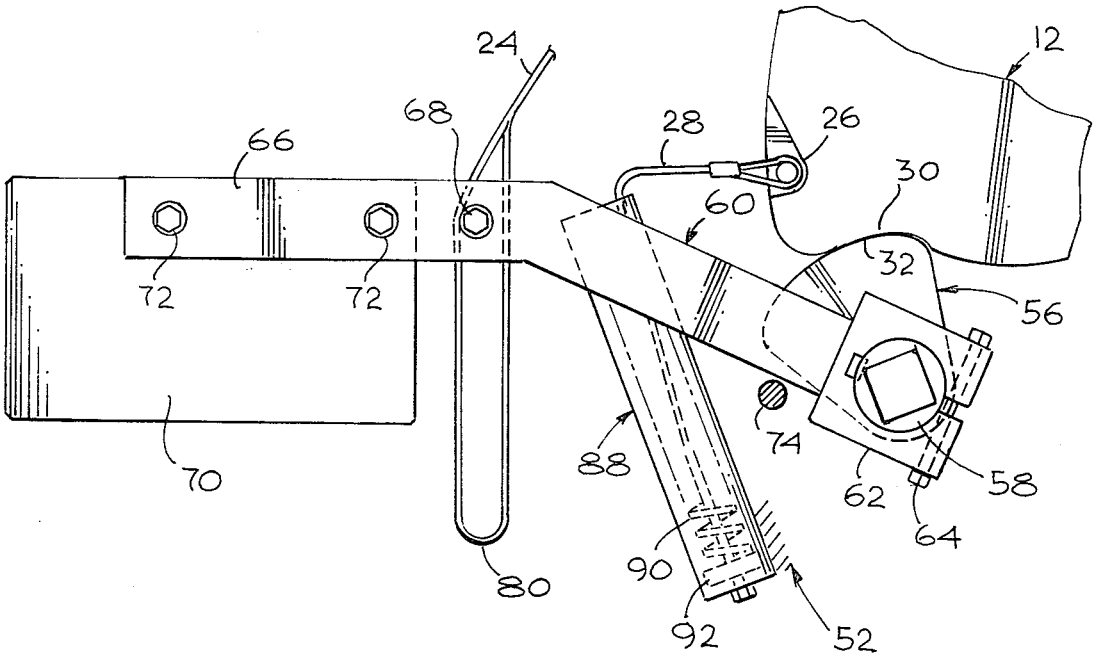
FIG. 4 is an enlarged section showing operation of the cam release and reset mechanisms.

The detail shown in FIG. 4 shows counterweight 70 attached to arms 60 by bolts 72. Shaft 68 between arms 60 is shown in its position inside of loop 80 in release cable 24. Release pin structure 74 is also shown positioning arm 60 in the engaged or locked position. Arm 60 is attached to cam shaft 58 through clamping extension 62 and bolt 64 so that rotation of shaft 58 is produced by the lowering of arms 60 in response to motion of counterweight 70, and rotation of cam 56 is produced thereby. Cam contact surface 32 and cam follower surface 30 on hook 12 are shown in relative contact, as is the reset structure previously described.

Figure 5:
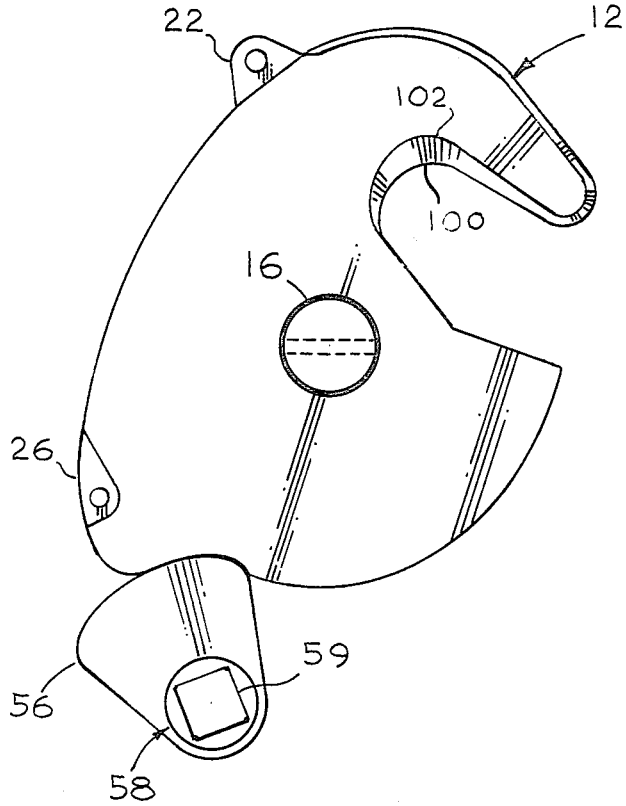
FIG. 5 is an enlarged view of the hook and cam of the apparatus of FIG. 1.

In FIG. 5, hook 12 and cam 56 are shown individually. Cam 56 rotates about shaft 58, and the hook rotates about pin 16 during operation. Disengaging lug 22 and reset coupling 26 are also shown. The ring contact surface of hook 12 is shown in more detail here in showing actual contact surface 100 and inset surface 102 which cooperate to form an easily slideable type of surface. The center of hook 12 extends past the outer edges, so that a V-shaped or arced extension is provided at the contact surface.

Figure 6:
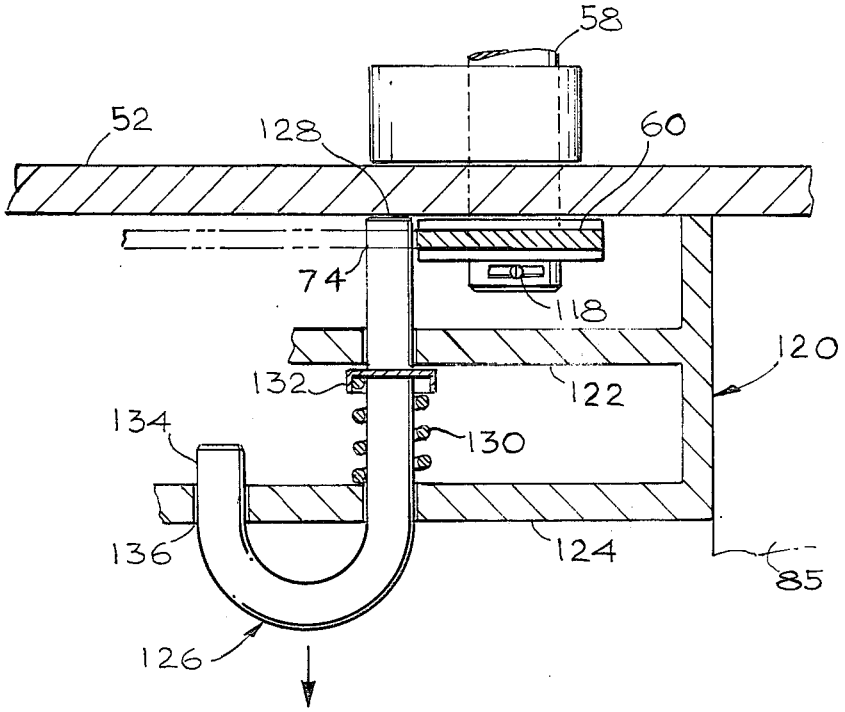
FIG. 6 is a sectional view showing a locking structure for the apparatus.

FIG. 6 shows one side of lower support structure 52 in section, and schematically shows cam shaft 58, arm 60 and an alternative arrangement for attaching the arm to the cam shaft, i.e. a cotter key at 118. In the structure shown, additional support and lock positioning channel 120 is attached to lower support surface 52, and provided with inner extension 122 and outer extension 124. J-shaped lock 126 engages support surface 52 at end 128 by virtue of biasing provided by spring 130 positioned between outer extension 124 and collar 132. J-shaped lock 126 is positioned by apertures in inner and outer extensions 122 and 124, respectively, and positively positions arm 60 when locked, as shown. However, the direct or remote application of force in the direction indicated by the arrow will overcome the biasing of spring 130 and release arm 60, as lock 126 can be pulled away from engagement with the surface of support 52. When J-shaped lock 126 is in the position shown, arm 60, as better seen in FIG. 1, cannot rotate, and thus the whole unit is locked in the engaged position. By application of the force in the direction of the arrow, J-shaped lock 126 is disengaged, at its shorter end 134, from aperture 136 in outer extension 124, and rotation of lock 126 about the axis of its longer shaft allows it to remain released, and be positively disengaged from arm 60.

Figure 7:
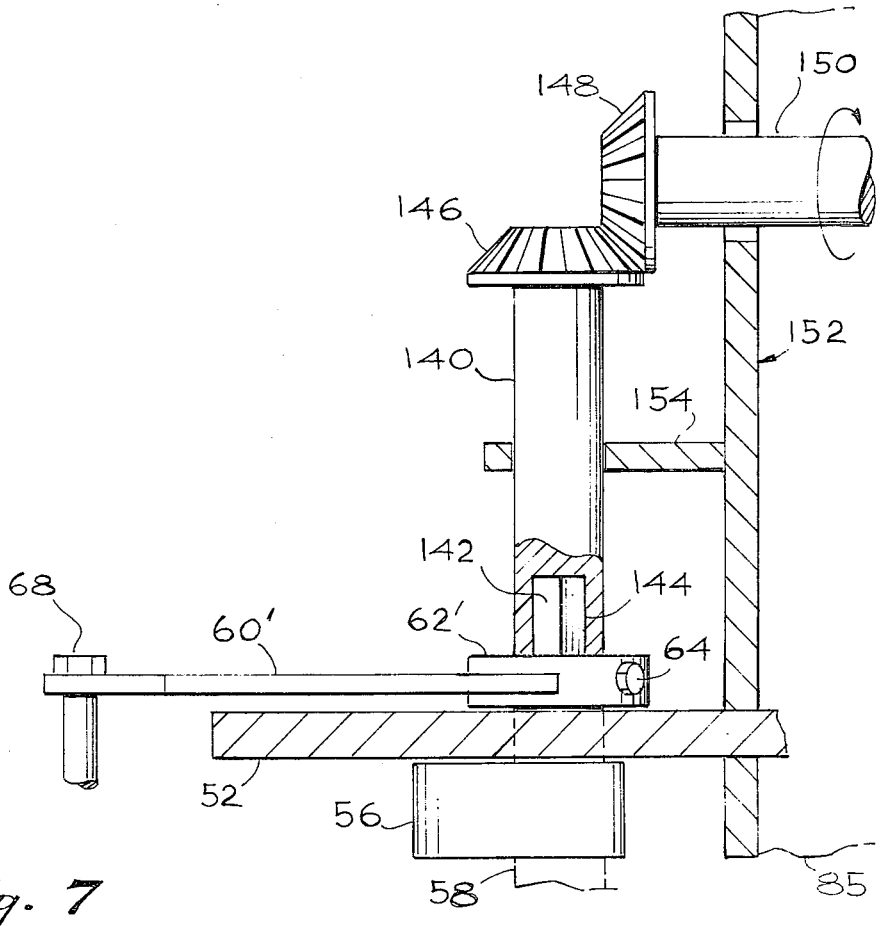
FIG. 7 is a schematic section of a remote release mechanism.

FIG. 7 illustrates an alternative driving arrangement as viewed in section showing the side opposite that shown in FIGS. 1 and 3. In this embodiment, alternative remote drive and/or counterbalance structure is provided. As in the prior figures, lower support plate 52 locates cam shaft 58, having attached thereto cam 56. Outside of support plate 52, lever arm 60' is mounted to cam shaft 58 through clamping extension 62' and bolt 64'. In this embodiment cam shaft 58 is provided with a hex drive head 142 which mates with extension shaft 140 by virtue of hexagonal female indentation 144. Shaft 140 is held in position by support structure 154, of any other suitable supporting means. Shaft 140 terminates in gear 146, which is mated with gear 148 on shaft 150. Shaft 150 is rotatably positioned in support structure 152, which may be the same as support 54 in FIG. 1, or a different supporting structure. This alternative structure allows for two separate additional embodiments of the present invention. First, a remote crank type or otherwise operated drive means may be utilized to positively rotate shaft 150 in the direction shown in the arrow thereon, and thus rotate shaft 140 and cause cam 56 to turn and release or disengage the hook. Thus, the structure provides for remote mechanical or other manipulation of the hook, independent of the function of counterbalance arm 60'.

As a second function, lever arm 60', and its related counterweight may be partially dispensed with, i.e. only the section of lever arm 60 through shaft 68 as shown in FIG. 1 need be provided. In this alternative, shaft 150 may be provided with, for instance, a spring structure (not shown) tending to rotate shaft 150 in the direction shown, with a predetermined torque. The spring may be replaced by the hydraulic accumulator, if desired, or by any other structure providing the appropriate torque. Thus, in this form the counterbalancing required herein is provided to shaft 58 by means other than the counterweight shown in the prior figures.

Figure 8:
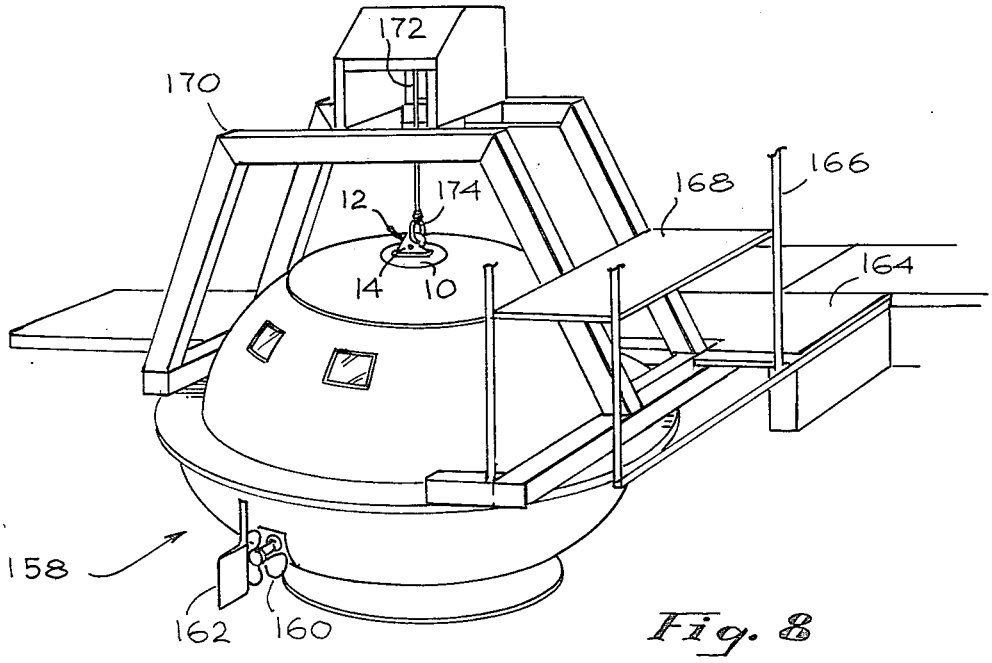
FIG. 8 shows the present apparatus in position suspending a survival capsule.

The survival capsule depicted in FIG. 8, indicated generally as 158, is provided with hook 12 positioned between plates 14 on housing 10, located at the top of the capsule. The capsule has a propeller 160 and rudder 162, and can be entered through a hatch, not shown, approached from decking 164. Scaffolding 166 provided with second deck 168 is also used around support beams 170 which typically position a hoisting motor such as a conventional electric winch provided with a suitable amount of cable on a drum, all of which is omitted for clarity of illustration. The cable 172 is provided with eye 174 which is positioned and held in place by the disengaging apparatus of the present invention. During storage, survival capsule 158 is hoisted by the winch, to a position where movement does not occur due to tension provided by contact of the survival capsule with the scaffolding structure. For testing or use the winch drive is activated and the gearing engaged to lower the capsule. Upon reaching the water, and when the helmsman is ready to cast off from the cable, the helmsman moves the safety pin 126 out of the blocking position for the lever arm 60. Since the tension on cable 172 is released by the bouyancy of survival capsule 158, the counterweight 70 rotates the cam 56 and the disengaging apparatus of the present invention operates to release the survival capsule from the cable.

Although there have been described above several specific arrangements of disengaging apparatus in accordance with the invention for the purpose of illustrating the manner which the invention may be used to advantage, it will be appreciated that the invention is not limited thereto. For example, although the invention has been disclosed in the context of a disengaging apparatus to a survival capsule, the apparatus could be utilized for equipment without the principles of the invention being rendered inapplicable. Accordingly, any and all modifications, variations or equivalent arrangements which may occur to those skilled in the art should be considered to be within the scope of the invention as defined by the appended claims.

What is claimed is:

1. Disengaging apparatus comprising:

a releasable hook including a contact surface, a pivot axis, and a cam surface;

a housing containing means for positioning said hook for rotation about the pivot axis;

a cam mounted on a shaft pivotable about a second pivot axis between first and second positions respectively blocking and permitting rotation of the hook;

means coupled to the cam for rotating the cam about the second pivot axis upon release thereof, said means comprising counterbalance means mounted to rotate the cam toward the second position; and hook rotating means operatively interconnected with the cam coupled means for positively pivoting the hook after rotation of the cam out of the blocking position.

2. The apparatus of claim 1 wherein the housing substantially encases the hook and includes positive disengaing means along a portion thereof.

3. The apparatus of claim 1 wherein the housing is shaped to clear the hook as it is rotated to the disengaging position.

4. The apparatus of claim 1 wherein the hook further contains a disengaging surface adjacent the contact surface.

5. The apparatus of claim 1 wherein the hook rotating means comprises flexible cable means attached at one end to the hook and effective to open the hook in response to rotation of the counterbalance means past the point where the cam is rotated out of the first position.

6. The apparatus of claim 1 further comprising independent locking means effective to prevent the release of the counterbalance means.

7. The apparatus of claim 6 wherein the independent locking means comprises a J-shaped pin spring-biased toward engagement with the counterbalance means.

8. The apparatus of claim 1 further comprising reset means effective to return the hook to the closed position at the conclusion of the disengaging cycle.

9. The apparatus of claim 8 wherein the reset means includes a cable attached at one end to the hook and means for retracting the cable to reset the hook.

10. The apparatus of claim 1 wherein the cam, the cam surface, and the counterbalance means are adapted to retain the cam in the locking position for pulling forces applied to the hook in excess of a predetermined level.

11. The apparatus of claim 1 wherein the shaft includes coupling means for engagement with a lever for manually rotating the cam between first and second positions.

12. Disengaging apparatus comprising:

a frame mounted on a support member, said frame including vertically oriented, spaced apart, support plates;

a cam mounted between the plates on a shaft rotatably support thereby to permit rotation of the cam between first and second positions respectively blocking and permitting rotation of a hook;

a releasable hook pivotably supported between said plates adjacent the cam shaft, the hook having a recessed surface for receiving the cam in the first position, the hook being free to rotate to an open position in which the hook is retracted between the plates upon movement of the cam from the first to the second position; and means for rotating the cam between first and second positions comprising a counterweight coupled to the cam shaft by a lever arm, the counterweight and lever arm being selected to rotate the cam from the first to the second position when the pulling force on the hook drops below a predetermined level.

13. The apparatus of claim 12 further comprising a cable coupled to the hook to cause rotation thereof toward the open position, and means coupling the cable to the counterbalance lever arm for engaging the cable after the cam has been rotated to the second position.

14. The apparatus of claim 13 wherein the cable engaging means comprises a loop in the cable of predetermined length to permit travel of the lever arm to the end of the loop during the rotation of the cam to the second position.

15. The apparatus of claim 12 further compirising means for coupling to the shaft to drive the cam out of the first position irrespective to the force on the hook.

16. The apparatus of claim 12 further comprising means for biasing the hook to the closed position during rotation of the cam from the second toward the first position.

17. The apparatus of claim 12 wherein the plates include means for clearing the jaw of the hook as the hook retracts between the plates.

* * * * *